US007132905B2

(12) United States Patent
Sano

(10) Patent No.: US 7,132,905 B2
(45) Date of Patent: Nov. 7, 2006

(54) INPUT/OUTPUT COUPLING STRUCTURE FOR DIELECTRIC WAVEGUIDE HAVING CONDUCTIVE COUPLING PATTERNS SEPARATED BY A SPACER

(75) Inventor: Kazuhisa Sano, Hiki-Gun (JP)

(73) Assignee: Toko Inc., Tokyo (JP)

( * ) Notice: Subject to any disclaimer, the term of this patent is extended or adjusted under 35 U.S.C. 154(b) by 79 days.

(21) Appl. No.: 10/980,957

(22) Filed: Nov. 4, 2004

(65) Prior Publication Data

US 2005/0099242 A1 May 12, 2005

(30) Foreign Application Priority Data

Nov. 7, 2003 (JP) ..... 2003-377915

(51) Int. Cl.
*H01P 5/107* (2006.01)
*H01P 1/207* (2006.01)

(52) U.S. Cl. ..... 333/26; 333/230; 333/208

(58) Field of Classification Search ..... 333/26, 333/230, 208, 248, 254
See application file for complete search history.

(56) References Cited

U.S. PATENT DOCUMENTS 4,716,387 A 12/1987 Igarashi
4,725,798 A * 2/1988 Igarashi ..... 333/212

FOREIGN PATENT DOCUMENTS

JP 2000-114813 4/2000
JP 2002-359508 12/2002

OTHER PUBLICATIONS

K. Sano et al., "A Transition from Microstrip to Dielectric-Filled Rectangular Waveguide in Surface Mounting", IEEE MTT-S International Microwave Symposium Digest, vol. 2, pp. 813-816, Jun. 2-7, 2002.

* cited by examiner

*Primary Examiner*—Benny Lee
(74) *Attorney, Agent, or Firm*—Cohen, Pontani, Lieberman & Pavane

(57) ABSTRACT

Disclosed is an input/output coupling structure for coupling a printed circuit board with a dielectric waveguide having a dielectric body and a conductive film covering the dielectric body. The coupling structure comprises a first conductive pattern formed on the bottom surface of the dielectric waveguide to serve as an input/output electrode, in such a manner as to be surrounded directly by an exposed portion of the dielectric body and further by the conductive film formed around the outer periphery of the exposed portion, a spacer having a surface made substantially entirely of a conductive material and a portion for defining a given space, and a second conductive pattern formed on a principal surface of the printed circuit board and electrically connected to the microstrip line. The bottom surface of the dielectric waveguide is joined to the principal surface of the printed circuit board through the spacer, to allow the first and second conductive patterns to be located in opposed relation to one another and define the space therebetween in cooperation with the spacer. The present invention can provide a simplified structure for mounting a dielectric waveguide on a printed circuit-wiring board to couple the dielectric waveguide with a microstrip line of the dielectric waveguide, and achieve a mode conversion mechanism operable in a wide frequency band and less subject to the influence of the possible displacement between the microstrip line and the dielectric waveguide.

2 Claims, 3 Drawing Sheets

INPUT/OUTPUT COUPLING STRUCTURE FOR DIELECTRIC WAVEGUIDE HAVING CONDUCTIVE COUPLING PATTERNS SEPARATED BY A SPACER

TECHNICAL FIELD

The present invention relates to a structure for coupling (connecting) a dielectric waveguide for use as resonators, filters, duplexers or the like, with a microstrip line formed on a printed circuit board.

BACKGROUND ART

While a cavity waveguide has been practically used as a low-loss transmission line for microwaves or millimeter waves, it involves difficulties in application to small-size electronic devices, such as portable communication terminals, due to inevitable increase in size and weight. In this connection, it is contemplated to utilize a dielectric waveguide which is prepared by forming a conductive film on a surface of a dielectric material. The dielectric waveguide has the advantage of effectively shortening the wavelength of an electromagnetic wave through its dielectric transmission line and eliminating the need for using a thick metal wall so as to facilitate downsizing and weight reduction thereof. This means that the dielectric waveguide has the potential to be mounted on commonly used printed circuit boards. Thus, the dielectric waveguide is regarded as one of noteworthy transmission lines for a small-size electronic component circuit usable in a high-frequency band, and various development efforts are being made toward its practical use.

Generally, an electromagnetic wave is transmitted through a microstrip line formed on the printed circuit board and a dielectric waveguide in different propagation modes. Therefore, in cases where the dielectric waveguide is used in such a manner that it is mounted on the printed circuit board and connected to the microstrip line, it is required to provide a mode conversion mechanism for converting one propagation mode in the microstrip line to the other propagation mode in the dielectric waveguide (see, for example, Japanese Parent Laid-Open Publication No. 2002-135003). This mode conversion mechanism is desired to be structurally simple and operable in a wide-frequency band. Further, if a dielectric waveguide is connected directly onto a microstrip line for use in a high-frequency band of 20 GHz or more, even a slight displacement therebetween will be highly likely to cause significant change in mode conversion characteristics and deterioration in practicality.

SUMMARY OF THE INVENTION

In view of the above circumstances, it is an object of the present invention to provide a simplified structure for mounting a dielectric waveguide on a printed circuit board and coupling between a microstrip line of the dielectric waveguide and the dielectric waveguide, and achieve a mode conversion mechanism operable in a wide frequency band and less subject to the influence of the possible displacement between the microstrip line and the dielectric waveguide.

In order to achieve the above object, the present invention employs a structure allowing respective conductive patterns of a dielectric waveguide and a microstrip line of a dielectric waveguide to be located in opposed relation to one another and define a space therebetween. Specifically, the present invention provides an input/output coupling structure for coupling between an input/output electrode of a dielectric waveguide and a microstrip line of a printed circuit board. The input/output coupling structure comprises a first conductive pattern formed on the bottom surface of the dielectric waveguide to serve as the input/output electrode, in such a manner as to be surrounded directly by an exposed portion of a dielectric body of the dielectric waveguide and further by a conductive film of the dielectric waveguide formed around the outer periphery of the exposed portion, a spacer having a surface substantially entirely made of a dielectric material and a portion for defining a given space, and a second conductive pattern formed on a principal surface of the printed circuit board and electrically connected to the microstrip line. In this input/output coupling structure, the bottom surface of the dielectric waveguide is joined to the principal surface of the printed circuit board through the spacer, to allow the first and second conductive patterns to be located in opposed relation to one another and define the space therebetween in cooperation with the spacer.

According to the above input/output coupling structure of the present invention, the two opposed patch-antenna-shaped conductive patterns can be electromagnetically coupled together to transmit high-frequency energy between the microstrip line and the dielectric waveguide. These conductive patterns located inside the space or cavity surrounded by the spacer, the dielectric waveguide and the printed circuit board, can reduce the leakage or less of electromagnetic energy. In addition, this arrangement can eliminate the need for electrical or direct contact between these conductive patterns to prevent deterioration in transmission characteristics which would otherwise be caused by possible displacement between the conductive patterns during packaging or assembling, and allow the restriction on positioning accuracy of the dielectric waveguide to be relaxed.

BEST MODE FOR CARRYING OUT THE INVENTION

A general input/output coupling structure according to an embodiment of the present invention will first be described.

A first patch-antenna-shaped conductive pattern is formed on the bottom surface of a dielectric waveguide. A second patch-antenna-shaped conductive pattern is also formed at the terminal end of a microstrip line of a printed circuit board for mounting the dielectric waveguide thereon.

In an operation for mounting the dielectric waveguide onto the printed circuit board, the first patch-antenna-shaped conductive pattern formed on the bottom surface of the dielectric waveguide is disposed in opposed relation to the second patch-antenna-shaped conductive pattern formed on the front surface of the printed circuit board. These opposed patch-antenna-shaped conductive patterns are kept in non-contact state or disposed to maintain a given distance therebetween.

A conductive wall is disposed to surround a space between the first and second opposed patch-antenna-shaped conductive patterns. The surrounding conductive wall is partially cut out only at a position where the microstrip line extends to enter into the space therethrough. The printed circuit board is also formed with another conductive wall surrounding the outer periphery of the coupling section (second conductive pattern) thereof Thus, a space or cavity is defined by the conductive wall, and the parallel surfaces consisting of the front surface of the printed circuit board and the bottom surface of the dielectric waveguide.

Figure 1:
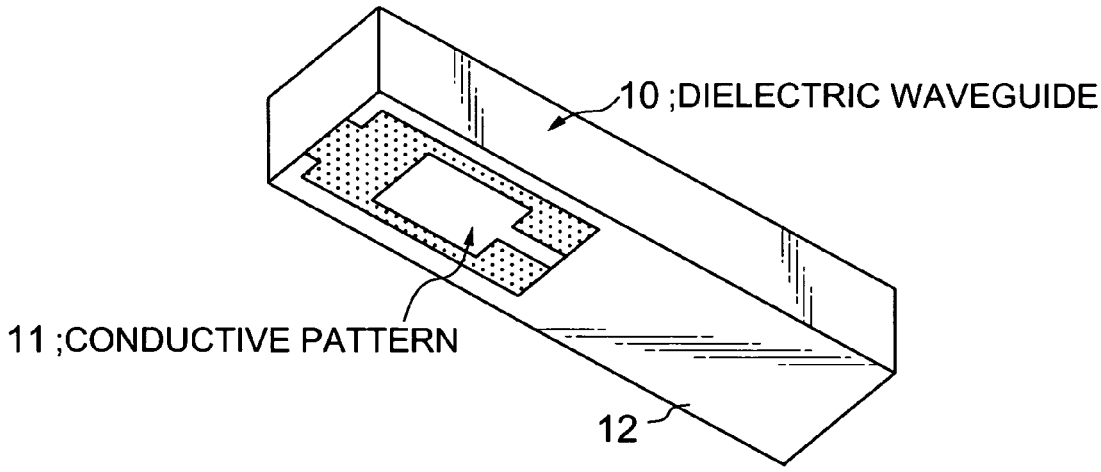
FIG. 1 is a perspective view showing an input/output section of a dielectric waveguide having a part of an input/output coupling structure according to a first embodiment of the present invention.

With reference to the drawings, an embodiment of the present invention will be described in more detail below. FIG. 1 is a perspective view of one of input and output terminals of a dielectric waveguide having a part of input/output coupling structure according a first embodiment of the present invention. The dielectric waveguide 10 has a rectangular parallelepiped shape, and comprises a dielectric body, and a conductive film 12 covering approximately the entire surface of the dielectric body to serve as an earth electrode. A portion of the bottom surface of the dielectric waveguide 10 is formed as a conductive pattern 11 consisting of an oblong patch-shaped conductive film. The outer periphery of the conductive pattern 11 is surrounded directly by an exposed portion of the dielectric body. Further, the outer periphery of the exposed portion is surrounded directly by the earth-electrode conductive film 12. In the first embodiment, the conductive pattern 11 is connected to the conductive film 12 through a conductive strip.

Figure 2:
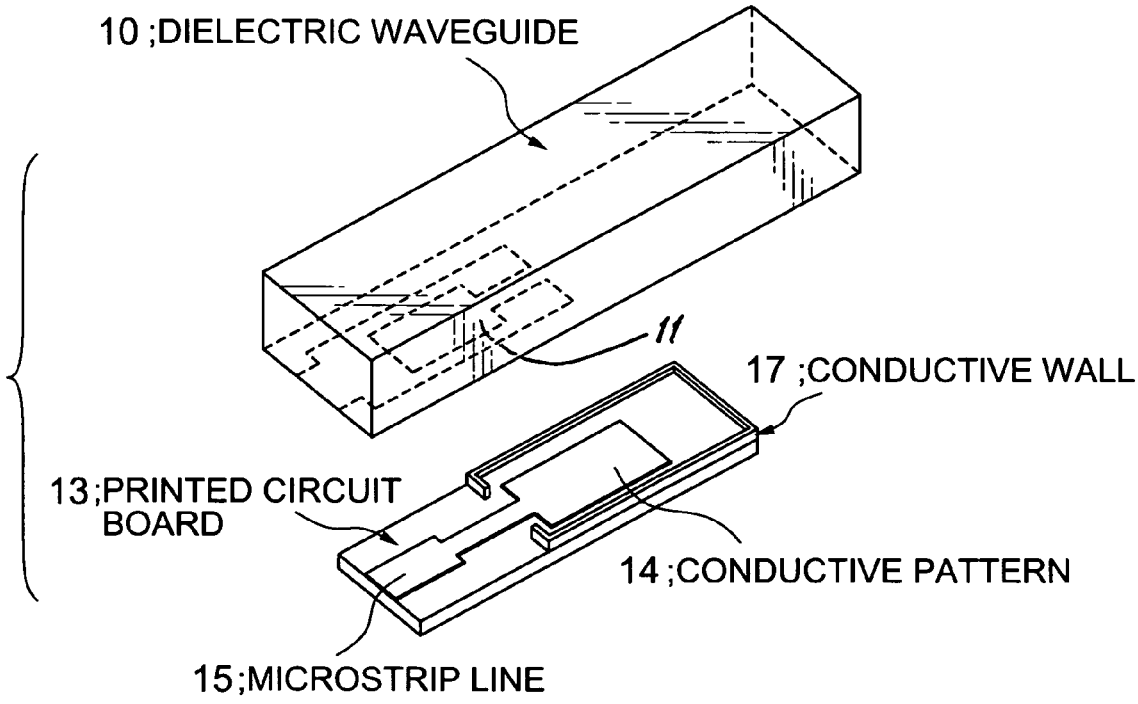
FIG. 2 is an exploded perspective view showing the input/output coupling structure according to the first embodiment of the present invention.

As shown in FIG. 2, a patch-antenna-shaped conductive pattern 14 is also formed at the terminal end of a microstrip line 15 of a printed circuit board 13. The conductive pattern 11 on the bottom surface of the dielectric waveguide 10 and the conductive pattern 14 on the front surface of the printed circuit board 13 are disposed in opposed relation to one another, and maintained to have a given distance therebetween. A conductive wall 17 is disposed to surround these conductive patterns, and the printed circuit board 13 and the dielectric waveguide 10 are firmly fixed together through the conductive wall 17 to define a space therebetween in cooperation with the conductive wall 17.

The microstrip line 15 and the dielectric waveguide 10 are electromagnetically coupled together by the opposed conductive patterns 11, 14 to allow electromagnetic waves to be transmitted therebetween. In a high-frequency range, a discontinuous portion in a junction between respective transmission lines is likely to cause a large radiation loss and significant deterioration in transmission characteristics. In the coupling structure according to the first embodiment, the discontinuous portion is located inside the space or cavity defined by the conductive wall, and opposed.

Figure 3:
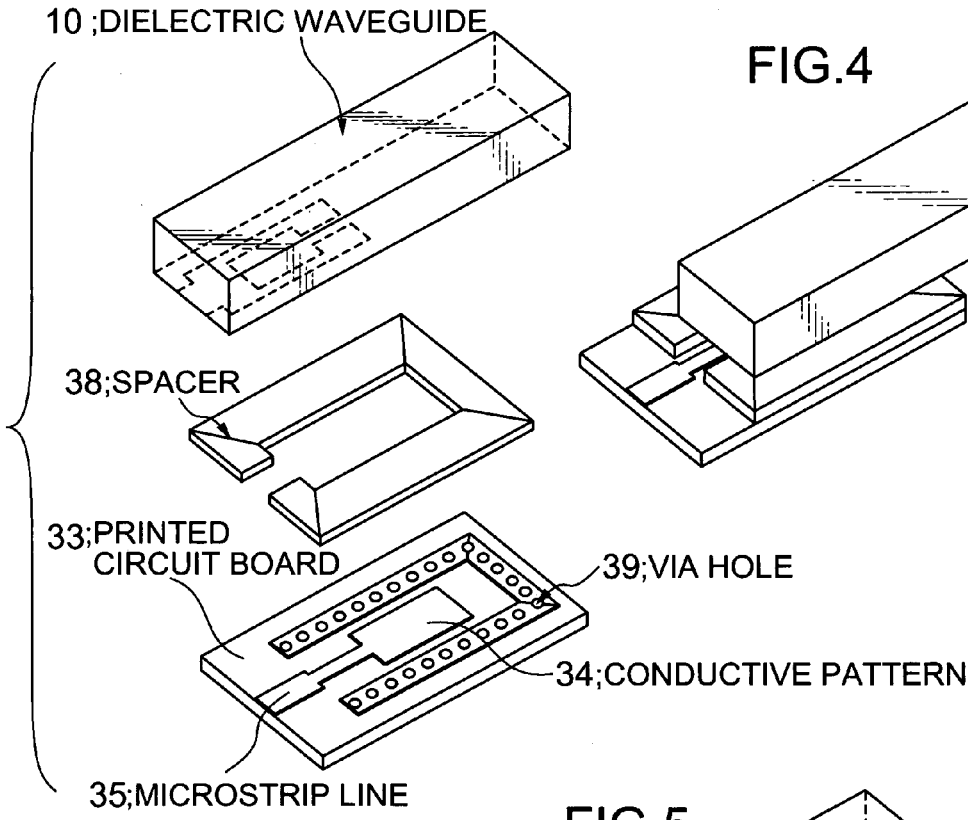
FIG. 3 is an exploded perspective view showing an input/output coupling structure according to a second embodiment of the present invention.
Figure 4:
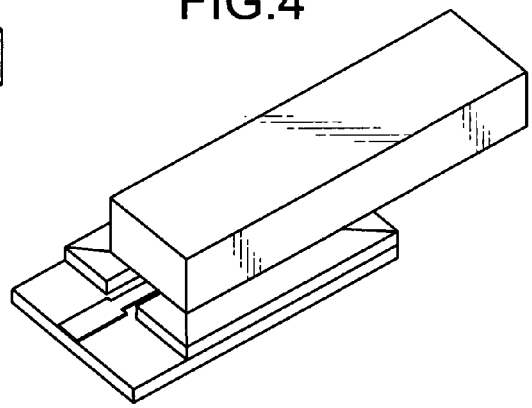
FIG. 4 is a perspective view showing the input/output coupling structure according to the second embodiment of the present invention.

FIG. 3 shows a practical input/output coupling structure according to a second embodiment of the present invention. In this embodiment, a microstrip line 35 includes a ground conductor formed on the bottom surface of a printed circuit board 33, and a strip conductor formed on the front surface of the printed circuit board 33. An array of via holes 39 are formed in the printed circuit board 33 to surround a coupling section (conductive pattern 34) formed at the terminal end of the strip conductor to serve as a conductive wall of the printed circuit board 33. A dielectric waveguide 10 having the same structure as that in the first embodiment is fixed to the front surface of the printed circuit board 33 through a spacer 38. The spacer 39 may be entirely made of a conductive material, or may be composed of a spacer body made of a resin material or a material of a printed circuit board, and a conductive film formed through plating to cover over the spacer body. In either case, the spacer is designed to have a shape allowing the opposed conductive patterns serving as coupling sections to be located inside a conductive wall consisting of the spacer. FIG. 4 shows the state after the dielectric waveguide is joined to the printed circuit board. As seen in FIG. 4, the opposed conducted patterns are located inside the region which is surrounded by the conductive film of the spacer, except for a portion of the conductive film overlapping with the strip conductor.

Figure 5:
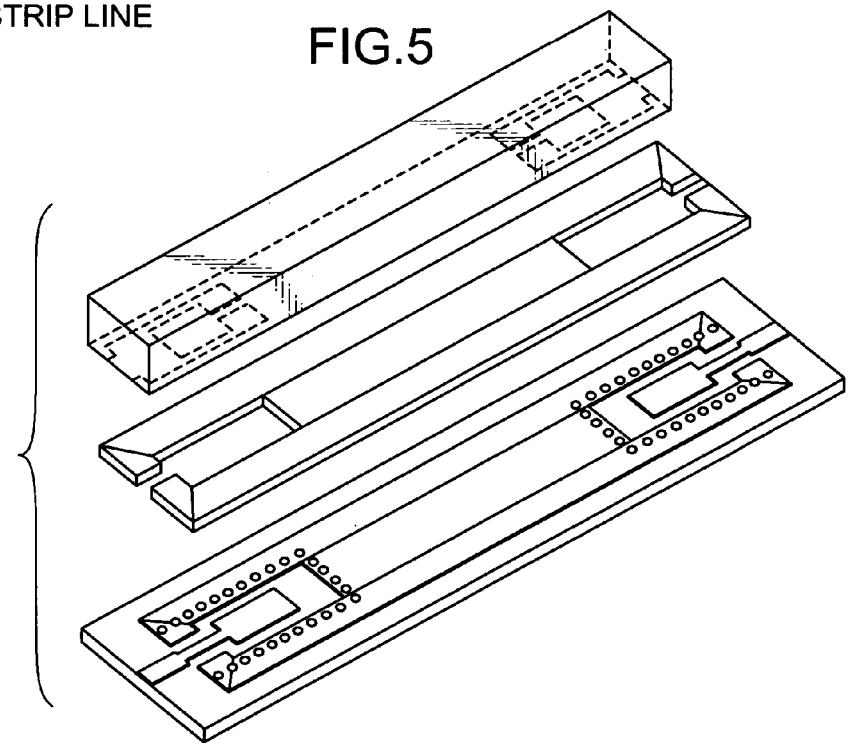
FIG. 5 is an exploded perspective view showing a dielectric waveguide filter prepared based on the second embodiment of the present invention.
Figure 6:
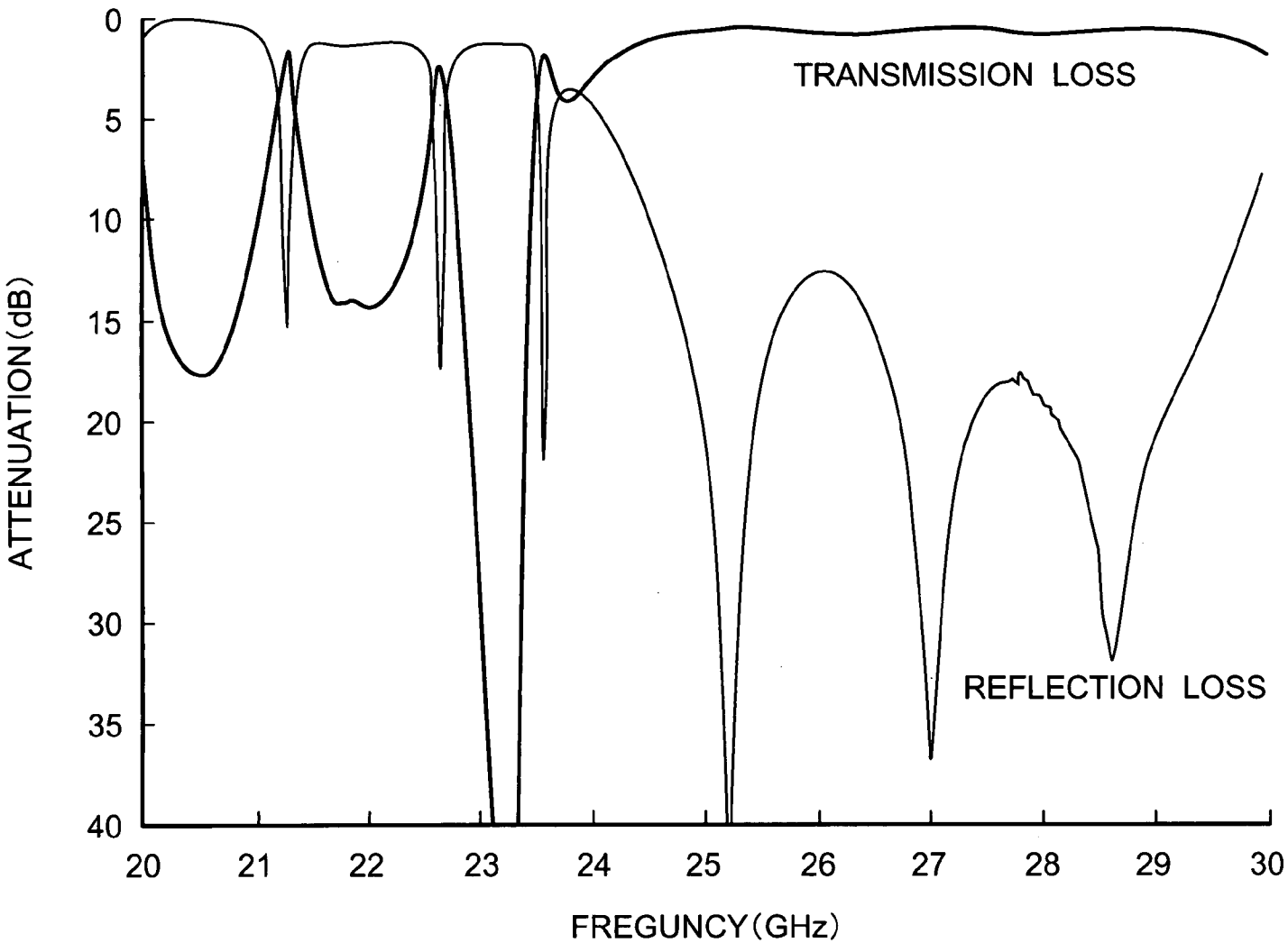
FIG. 6 is an explanatory diagram of the characteristic of the dielectric waveguide filter in FIG. 5.

FIG. 5 is an exploded perspective view of a sample prepared for measuring the characteristic of the input/output coupling structure according to the second embodiment of the present invention. The sample is formed as a filter having input and output electrodes. A dielectric waveguide with a sectional size of 4 mm×2.5 mm was prepared using a dielectric material having a specific inductive capacity of 4.5. The dielectric waveguide was designed to have a length of 30 mm, and a pair of converters was formed, respectively, at the opposite ends of the dielectric waveguide to convert between the modes in the dielectric waveguide and the microstrip line. Then, transmission and reflection characteristics were measured during the conversion. The conversion section was designed to have a length of about 7 mm. The measurement result of the conversion characteristics is shown in FIG. 6. The filter had a reflection loss of 12 dB or more, and a transmission loss of 0.6 dB in the range of 25 GHz to 29 GHz. This verified that the input/output structure of the present invention can provide excellent conversion characteristics.

INDUSTRIAL APPLICABILITY

The present invention is significantly useful in downsizing and weight reduction of a transmission line for use in a frequency range in which there has been no choice but to use a large heavy cavity waveguide.

What is claimed is:

1. An input/output coupling structure for coupling between an input/output electrode of a dielectric waveguide and a microstrip line of a printed circuit board, said dielectric waveguide including a dielectric body and a conductive film covering a surface of said conductive body, said structure comprising:

a first conductive pattern disposed on the bottom surface of said dielectric waveguide to serve as said input/output electrode, in such a manner as to be surrounded directly by an exposed portion of said dielectric body and further by the conductive film located around the outer periphery of said exposed portion;

a spacer having a surface comprised substantially entirely of a conductive material, and a portion for defining a given space; and a second conductive pattern disposed on a principal surface of said printed circuit board, and electrically connected to said microstrip line, wherein said bottom surface of said dielectric waveguide is joined to said principal surface of said printed circuit board through said spacer, to allow said first and second conductive patterns to be located in opposed relation to one another and define said space therebetween in cooperation with said spacer.

2. The input/output coupling structure as defined in claim 1, wherein said dielectric waveguide has a rectangular parallelepiped shape, and said first conductive pattern comprises two conductive patterns disposed, respectively, at the opposite ends of the bottom surface of said dielectric waveguide, wherein said dielectric waveguide comprises a dielectric waveguide filter having one of said two conductive patterns serving as an input electrode for the dielectric waveguide filter, and the other of said two conductive patterns serving as an output electrode for the dielectric waveguide filter.

* * * * *